US006572324B2

(12) United States Patent
Ihm

(10) Patent No.: US 6,572,324 B2
(45) Date of Patent: Jun. 3, 2003

(54) TRANSVERSELY DRIVEN PROJECTION AND RETRACTION ASSEMBLY

(76) Inventor: Jason Tory Ihm, 10436 Cty ID, Bllue Mounds, WI (US) 53517

( * ) Notice: Subject to any disclaimer, the term of this patent is extended or adjusted under 35 U.S.C. 154(b) by 5 days.

(21) Appl. No.: 09/924,887

(22) Filed: Aug. 8, 2001

(65) Prior Publication Data

US 2002/0028126 A1 Mar. 7, 2002

Related U.S. Application Data

(63) Continuation-in-part of application No. 09/353,272, filed on Jul. 14, 1999.

(51) Int. Cl.[7] ..... B66F 9/00

(52) U.S. Cl. ..... 414/723; 414/912; 37/405; 37/903

(58) Field of Search ..... 414/722, 723, 414/727, 785, 912; 37/405, 903

(56) References Cited

U.S. PATENT DOCUMENTS 2,973,878 A * 3/1961 Gibson ..... 414/785 X
3,795,070 A * 3/1974 Bronson et al. ..... 414/722 X
4,149,553 A 4/1979 Lee

* cited by examiner

*Primary Examiner*—Donald W. Underwood
(74) *Attorney, Agent, or Firm*—Loyd W. Bonneville

(57) ABSTRACT

A free-floating hydraulic piston cylinder situated in side-to-side orientation in which the piston rod advances from the cylinder which it causes to move in the opposite direction. To the piston rod as well as to the opposite end of the cylinder is connected linkage which changes the direction of force and pushes a moveable frame with attached spears in a forward ready-for-work direction. This arrangement permits the attachment of a great number of the spears because the moving frame can be efficiently acted upon all the way along its length rather than just near its middle portion.

16 Claims, 8 Drawing Sheets

TRANSVERSELY DRIVEN PROJECTION AND RETRACTION ASSEMBLY

This instrument, filed under 37 CFR 1.53(b) and 1.78, invoking the provisions of 35 U.S.C. 120, is a Continuation in Part of presently copending application Ser. No. 09/353,272 entitled "Utility Implement Projection and Retraction Assembly", filed Jul. 14, 1999

BACKGROUND OF THE INVENTION

1. Field of the Invention

Farm equipment; construction equipment

2. Description of the Prior Art

Occasionally a descriptive term in this application may be shortened so as to recite only a part rather than the entirety thereof as a matter of convenience and to avoid needless redundancy. In instances in which that is done, applicant intends that the same meaning be afforded each manner of expression. Thus, the term hydraulic piston cylinder (2) might be used in one instance but in another, if meaning is otherwise clear from context, expression might be shortened to piston cylinder (2) or merely cylinder (2). Any of those forms is intended to convey the same meaning.

The term attach or fasten or any of their forms when so used means that the juncture is of a more or less permanent nature, such as might be accomplished by nails, screws, welds or adhesives. Thus, it is stated herein that the piston rod (9) is attached to the transverse projection shaft (41). The expression pivotally attached means that two parts or objects addressed are connected by a more or less permanent juncture but one which, nevertheless, permits the first to rotate with reference to the second at an axial point common to both. Thus, the spreading links (42) are stated herein to be pivotally attached to either the fixed frame (61), the moveable frame (51) or to the transverse projection shaft (41), meaning that the links (42) are free to pivot at the respective points of connection (41, 51, 61). A connection in which one object is easily removed from another would, if relevant herein, be described by the word emplace. Employment of the words connect or join or any of their forms is intended to include the meaning of both in a more general way.

The word comprise may be construed in either of two ways herein. A term used to describe a given object is said to comprise it, thereby characterizing it with equivalency in meaning for the term. Thus, it might be stated that the means of forcing the moveable frame (51) apart from the fixed frame (61) in part comprises one or more spreading links (41), meaning that in the particular case, the links (41), at least in part, are such means. However, the word comprise may also be used to describe a feature which is part of the structure or composition of a given object. Thus, a hydraulic piston cylinder (2) may be said to comprise a piston rod (9), meaning that the structure of the cylinder (2) is such as to have the piston rod (9) as a feature of its structure. The meaning in the respective cases is clear from context, however. Accordingly, modifying words to clarify which of the two uses is the intended one seem unnecessary.

The words forward or rearward and root variations thereof are intended to designate the situs of an object described with reference to the orientation of the operator of a given utility vehicle. Thus, when a spear (14) is discussed in terms of frontal attachment or forward movement, reference is intended to be consistent with the direction the front of the vehicle (100) points as well as that in which the operator faces while driving it (100). The words top or bottom, upper, or lower, similarly refer to such relative orientation.

In keeping with common understanding, the terms inboard and outboard express disposition of an object or point with reference to the centrally situated part of the structure. An inboard disposition means that the object or point is located nearer the center than is an outboard one. The terms inward and outward are similarly used. Thus, in one embodiment of the invention, when the assembly (40) is disposed in what is described herein as the closed position, each spreading link's (42) first end is stated to be disposed inboard that of the second thereof since that end is more medially located. The term outboard, on the other hand, refers to parts or elements situated more remotely from the assembly's (40) center, such as in the case of the second end of the spreading link (42) in the foregoing example.

The term scissor-like refers to a herringbone pattern provided by the rearward and forward links (42) respectively along a given extension (46) of the projection shaft (41) when the assembly (40) is in a closed or intermediate position. Because the rearwardly disposed links (49) lie parallel to one another along the given projection extension (46) and are together directed either inward or outward and the forwardly disposed links (48) also lie parallel one another along that extension (46) together directed inward or outward in the same manner as the rearwardly disposed ones (49), all of which is explained ante, a series of V-like shapes is provided collectively comprising the herringbone configuration.

The word multiply may connote either of two intended meanings. Its use as a verb is, of course, well known. However, when employed herein as an adjective, it denotes plurality, such as the expression multiply arrayed spears (14)—in the manner doubly or triply are used as adjectives.

In both farming and construction, it is occasionally useful to have the capability of loosening up compacted substantially sized bundles or masses of hay, manure or similar materials, grasping and moving them about with a utility vehicle (100) of one sort or another. For such use, forward projecting tines or spears (14) may be employed. It would also be useful to have the capability of lowering an elastic scraper (23) and moving it (23) along a floor for cleaning purposes in the fashion of a squeegee. Operations of both sorts at first depended upon certain operable linkages mechanical in nature—such as chains, wires and booms—but ultimately were made to rely upon hydraulic systems.

The loading bucket (101) itself is extremely useful in scooping dirt, gravel, manure or other loose grainy materials; in lifting and transporting substantial volumes of those or other materials; and in digging or gouging operations. It has even become an occasional practice to configure the bottom (104) of the bucket (101), at the front thereof (101), with a chiseled edge (102). Because they are fixed in place so as to present an obstruction, frontal accessories used in prior art generally require that one forego use of the loading bucket (101) for its (101) usual or traditional intended purpose.

A hydraulic system comprises a sealed hydraulic cylinder (2) into which hydraulic oil-like fluid passes to push a piston rod (9) within it (2) along its (2) length and beyond so as to accomplish necessary work. The piston rod (9) is designed, of course, to remain anchored or stopped within the cylinder (2) so that it does not fall out of it (2) when extended. Moreover, such configuration provides a fixed limit to the maximum distance the rod (9) extends from the cylinder (2). Operably, however, it (9) may be made to extend to any intermediate position. Because the hydraulic fluid for all practical purposes retains its volume without compression, the force it exerts can be transmitted a considerable distance through hydraulic feeder lines (3). Variations in cylinder (2) volume can provide within the system mechanical advantage, as that terminology is used in matters of physics.

Especially useful are cylinders (2) which allow the fluid to enter on either side of the piston rod (9) within, thus allowing it (9) to accomplish work first in a forward direction and then a reverse one, depending upon the particular need. For such a two-way or reciprocal system, as designated herein, a pair of hydraulic feeder lines (3) is, of course, required. Typically, the operator manipulates a hand lever to engage the cylinder (2), causing hydraulic fluid to act through one of the feeder lines (3) and move the piston (9) in the direction selected. To reverse its (9) direction, the operator manipulates either a second hand lever or, if the system is so designed, the same one in a reverse manner. A variety of hand controls are known in the art.

Since hydraulic systems have already become popular as the power mechanisms employed to manipulate a loading bucket (101) in one dimension or another, they would conveniently lend themselves to empower the operations inherent to frontal accessories of the sort discussed herein.

The vehicles with which frontal implements of the sort discussed herein—spears (14) or elastic scrapers (23)—have been employed at prior art might comprise a tractor (100) rigged up with a frontally disposed utility bucket (101) but, more commonly, one generally known as a "front end loader", occasionally dubbed a "skid steer" (100). The vehicle (100) is one whose various powered bucket (101) lifting and tilting is accomplished by the lever manipulated hydraulic mechanisms mentioned supra. Thus, the frontally disposed bucket (101) may be lowered to the ground and pivoted on a horizontal axis such that material is scooped into its (101) cavity; then raised and tipped to dump its (101) contents at a location the loader vehicle (100) has taken it to. Even without employing the bucket (101), material such as hay and manure may be collected on an array of tine-like spears (14) of the sort developed in prior art and moved in similar fashion.

While the multiply arrayed frontal spears (14) and the elastic scrapers (23) of prior art have been useful in their employment, no provision had been made to facilitate conversion to alternative traditional use of the vehicle (100) and bucket (101) de hors that implementation (14, 23). Thus, if the operator, after either using the scraper (23) for cleaning purposes or the spears (14) for transport of a bundle of hay or the like, desired to employ the bucket (101) to which either the spears (14) or scraper (23) was attached, he or she would be obliged to disconnect that implementation (14, 23) from the system and then attach or otherwise connect a simple bucket (101) in its place.

Though not a necessity, it would also be useful if the same mechanism could be used to conveniently alternate between spear (14) arrayal and squeegee operations. It would seem sufficient that the invention provides both a retractable spear (14) arrayal and a retractable squeegee. Separate loading buckets (101) would, respectively, accommodate the two applications. There would, thus, be a first bucket (101) comprising a moveable frame (51) and spear (14) array and a second one (101), an elastic scraper (23). While projectability and retractability of each of those assemblies would seem to be meritworthy on their own, in the further interest of economy, it would be of considerable benefit to allow one to change from spear (14) to squeegee operation without having to disengage one loading bucket (101) to connect to another (101). It would, thus, be useful that the invention repose in an embodiment by which an elastic scraper (23) might be mounted directly upon spears (14).

Numerous patents extant in the prior art are cited in the copending parent application. Although they are not repeated here, they are enlightening as an exposition of the history leading to implements of the sort under consideration herein. Some of them, for example, cite patents comprising mechanisms in which spears (14) employed with a utility vehicle (100) are bolted in place. Others of them refer to patents comprising mechanisms in which hydraulic power is employed for various related functions. Some of those historical patents comprise devices used in fork lift application. Still others incidentally address patents by which tines, or spears (14) are disposed rearward of the utility vehicle (100) in dragging fashion.

Experience has demonstrated that a forward driving and supporting cylinder and piston—or ram, as it is sometimes called—attached to the bottom (103) of a frontally connected loading bucket (101) limit in a practical sense the number of spears (14) which may be employed. Moreover, those (14) near the bucket's sides (103) sometimes tend to bind because the forward thrust of the device is centrally located, causing unwanted leverage upon the peripheral parts thereof. As useful as the forward supported predecessor of the present invention is, some means of dispersing the supporting force all along the spear (14) array, permitting the incorporation of a great—nearly unlimited—number of them (14), would be enthusiastically welcomed.

To that end, a transversely oriented system, perhaps operating somewhat on the principal of the simple ancient umbrella, as evinced in the prior art cited in U.S. Pat. No. 4,149,553 issued to Lee, might with suitable modifications, be instructive.

The needs or objectives pointed out supra thus far remain only partly addressed in the prior art. Before the advent of the copending application mentioned supra, presumably destined to become the parent hereof, some of the needs had not been met at all. That application addressed several of them. It nevertheless remains, to meet the issues also raised herein.

SUMMARY OF THE INVENTION

The invention comprises a mechanism which in a very special way permits certain implements or accessories attached to the loading bucket (101) of a utility vehicle (100) to be hydraulically projected forward out of the bucket (101) and retracted rearward back into it (101). Typically included as such are an array of spears (14) with or without attachment of an elastic scraper (23), both of which are in immobilized embodiments known to prior art. In providing versatility in projection and retraction of the accessories or assemblies, the loading bucket (101) may alternatively be employed for the traditional functions for which it (101) was originally designed without laborious disassembly.

As in the parent application hereto, the invention provides an array of spears (14) which are capable of being projected forward of the loading bucket (101) and, after having dedicated them (14) to their (14) intended work, withdrawn out of the way so that the bucket (101) may be used as though the spears (14) were absent. The invention also, thus, provides a flexible scraper (23) for squeegee cleaning operation which may also be projected forward of the bucket for work and afterwards withdrawn into the bucket (101) substantially out of the way.

The subject matter hereof differs from that of the parent application, however, in disposing the power train transversely to the direction of spear (14) projection. To that end, a linkage is disposed to evenly transfer power derived from the transversely oriented piston cylinder (2) along a forward directed component. Connected to the opposing ends of the piston, the linkage (41, 42) comprises a projection shaft (41) and spreading links (42) which, working in combination, pry and spreads the moveable and fixed frames (51, 61, respectively) apart, spreading them (51, 61) to advance the spears (14) through extender guides (5) preferably present and disposed within a spear casing (63). As the piston rod (9) is caused to advance, the free-floating piston cylinder (2) is simultaneously caused to retreat, or move in the opposite direction. The invention is said to be a two-way assembly by reason of the fact that the hydraulic cylinder, well known to prior art, acts in either direction, enabling opening and closing of the assembly (40) with corresponding advancement and withdrawal of the spears (14).

BRIEF DESCRIPTION OF THE DRAWINGS

Solid lines in the drawings represent the invention. Dashed lines represent either non-inventive material; that not incorporated into an inventive combination hereof and which may be the subject of another invention; or that which although so incorporated, lies beyond the focus of attention.

FIG. 15 illustrates links wherein the forwardly disposed links (48) are of length different from the rearwardly disposed ones (49), but nevertheless exhibiting relative correspondence of link (42) pattern array. shows links (42) arrayed in alternate pattern;

FIG. 17, pairs comprising non-regularity and

FIG. 18, a non-paired arrangement comprising non-regularity.

FIG. 19 depicts links arranged wherein the number or forwardly disposed links (48) is different from that of the rearwardly disposed ones (49).

DESCRIPTION OF THE PREFERRED EMBODIMENT

Figure 1:
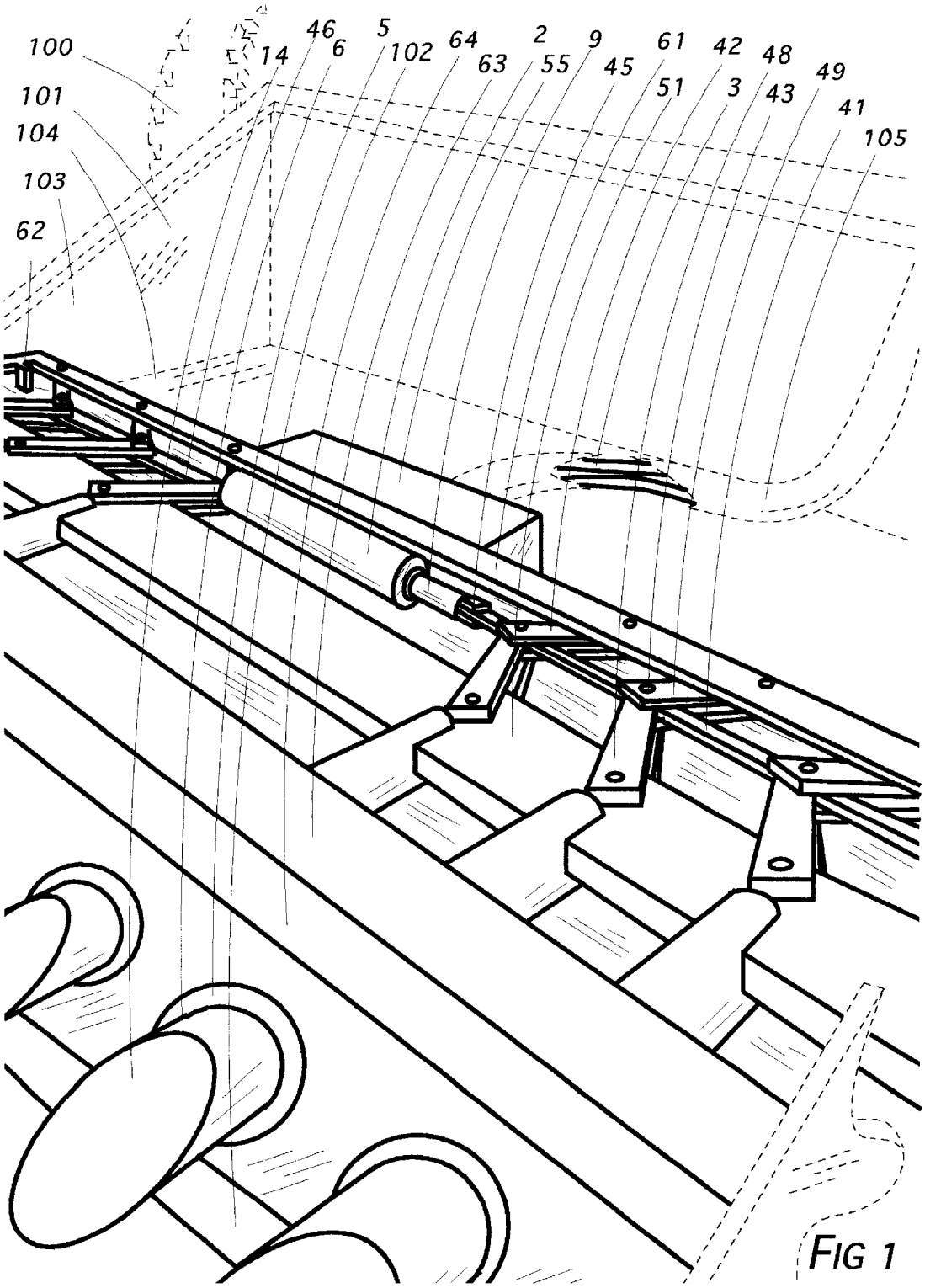
FIG. 1 represents a perspective view of an embodiment of the invention in which the first ends of the spreading links (42) are disposed inboard the second ends thereof (42), deploying the herringbone array open outward upon both extensions (46) of the transverse projection shaft (41) when the piston rod (9) is withdrawn into the cylinder (2) comprising it (9). The spears (14) are shown in partly projected disposition.
Figure 2:
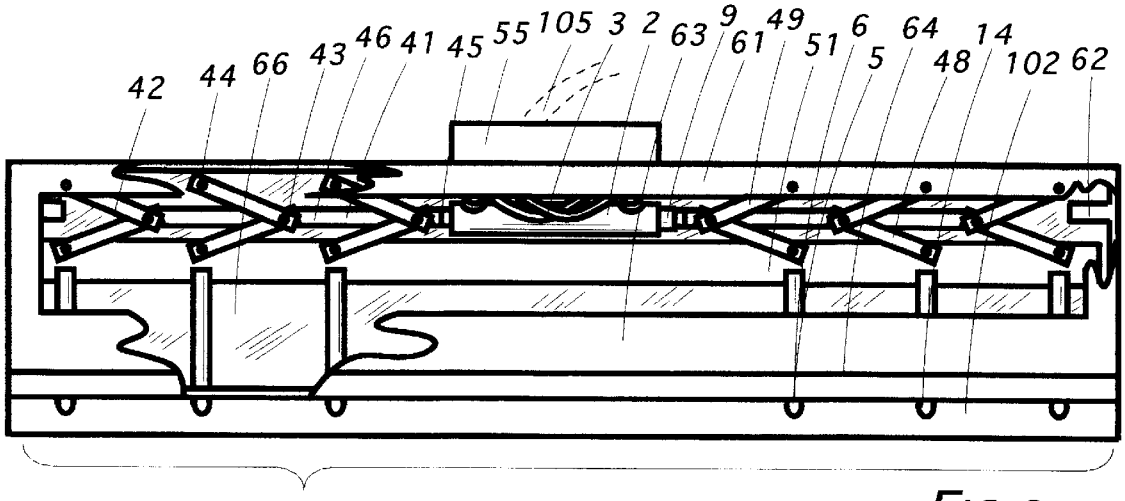
FIGS. 2–4 depict the most familiar version of the assembly (40) from overhead in closed, intermediate and open position, respectively. If the three illustrations could be seen in animation, it would be instructive to observe that the free-floating cylinder (2) moves from a rearward medial situs in a direction forward and to the left—that is, in an away-from-the piston rod (9) direction—as the spears (14) are projected forward.
Figure 3:
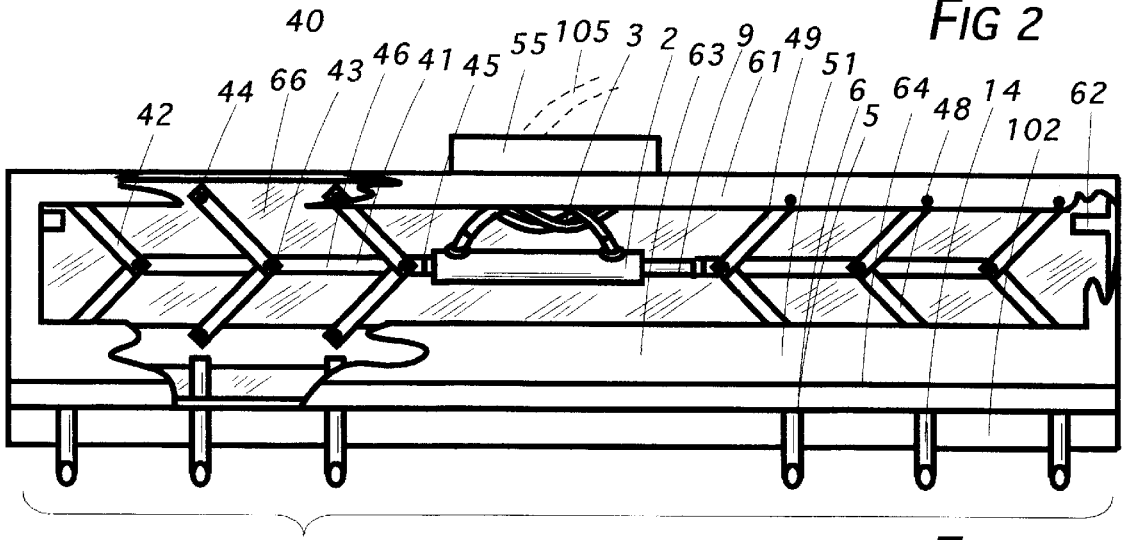
Figure 4:
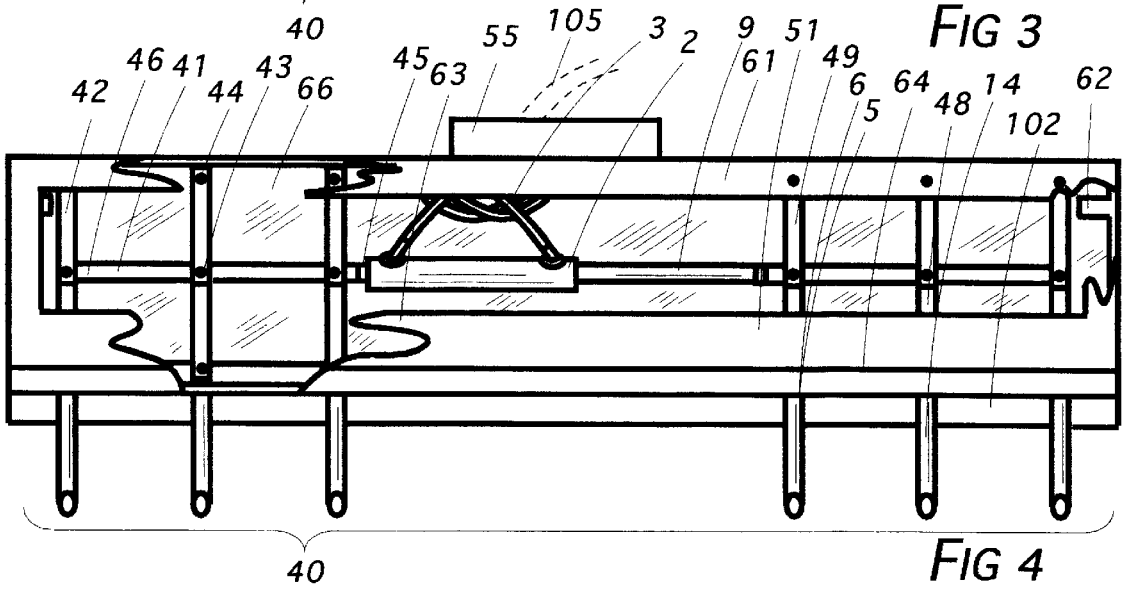
Figure 5:
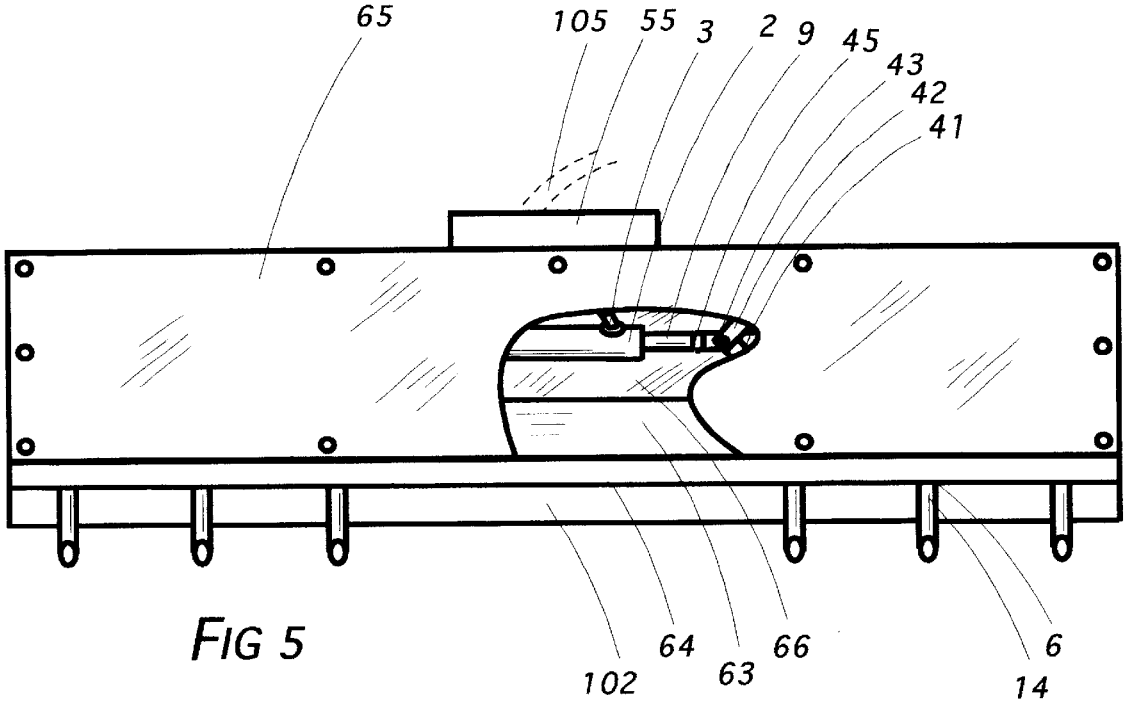
FIG. 5 comprises an overhead view also in which the overlying cover (65) is in place. As in the three preceding drawings, the underlying pan (66) is also provided.

The invention comprises a transversely driven projection and retraction assembly which, on the one hand, comprises an improvement to certain well known farm or construction vehicle (100) frontally disposed implements and, on the other, a combination of well known objects. The implements may comprise an array of spears (14) or an elastic scraper (23). Other implements, not immediately evident, may also be so used as part of the invention.

Considered as an improvement, the invention permits the utility accessory or appendage, whether a plurality of spears (14) or a spear (14)—elastic scraper (23) combination, to be extended from the bucket (101) for intended use and afterwards withdrawn to its (14, 23, respectively) original station so that the bucket (101) can be used more or less as one (101) would be if no such appendage (14, 23) were present. The novelty, therefore, is in the projectability and retractability of the respective utility assembly (14, 23).

Considered as a combination of known objects, the invention comprises those configured and disposed as set forth ante.

As depicted in the embodiment shown in FIGS. 1–4, a moveable frame (51) is disposed by attachment within a loading bucket (101) frontally connected to a utility vehicle (100) such that a piston rod (9) comprised by a hydraulic piston cylinder (2) pushes intermediate linkage (41, 42) which in turn projects the moveable frame (51) forward to a position in front of the bucket (101); and then alternately pulls against the linkage (41, 42) to cause the moveable frame (51) to recede to a position within the bucket (101).

As we shall see, an embodiment may be devised in which the piston rod (9) does not push against the intermediate linkage but, rather, pulls against it to project the spears (14) forward; and then, alternately, pushes against the linkage to withdraw them (14). Which embodiment is employed is merely a matter of arbitrary convenience since either performs equally well. To avoid awkward redundancy and perhaps, needless confusion, the rod (9) pushed projecting variation is the focus of primary attention herein, although the invention actually features either in the same concept.

The moveable frame (51) in some embodiments comprises merely a beam-like transverse character to which spears (14) are attached. It should be readily apparent that for such an embodiment, retraction of the moveable part of the two-way transverse projection assembly (40) must stop short of the rearmost part of the bucket (101) so as to allow space for the fixed part of the assembly (40). A fixed frame (61) is preferably disposed by attachment along a midportion of the bucket (101).

The invention, then, is an assembly (40) comprising a fixed frame (61), a moveable frame (51), a plurality of spears (14) preferably disposed within associated extender guides (5), a hydraulic piston cylinder (2) supported by reciprocal hydraulic feeder lines (3), a transverse projection shaft (41) divided into opposing extensions (46) and a plurality of spreading links (42). Pivotal attachment means—that is, means by which the links (42) are pivotally attached—preferably comprising pivotable bolts (43)—are also included. Certain other features may optionally be present including an overlying cover (65), underlying pan (66) and an assembly attached to the spears (14) comprising an elastic scraper (23), accompanying scraper bracket (106) or other attachment means and scraper backing plate (25).

The fixed frame (61), disposed in a generally horizontal attitude and attached to the bucket's bottom (104), preferably comprises more or less rectangular configuration.open in the midportion thereof (61). The foremost portion thereof (61) is preferably shaped to provide a spear casing (63), beneath and through which (63) the spears (14) are caused to project and retract.

The top of the casing (63) at the very most forward portion thereof (63) is preferably slanted downward to provide a loading facilitation bevel (64) which allows a procured load to slide back easily into the bucket. An overlying cover (65), if present, keeps the load separated from impediments created by the invention's parts beneath it (65). If the front of the cover (65) is disposed proximate the facilitation bevel (64), loading is considerably enhanced.

Extender guides (5) equal in number to that of the spears (14) disposed in a forward directed aspect are also preferably present. The spears (14) when projected and retracted slide freely within the tube-like extenders (5) and are thereby restrained from any lateral movement. Frontal guide openings (6) through which the spears (14) protrude to a lesser or greater degree depending upon whether the assembly (40) is closed, open or at some intermediate position, are also preferably provided at a point beneath the bevel (64).

As a matter of definition, an open disposition of the assembly (40) is characterized by a link (42) array in which the first and second ends of each (42) are aligned to point directly forward. At that point, the moveable frame (51) has been spread apart from the fixed frame (61) as much as possible and the spears (14) are projected as far forward as they (14) can possibly be. In a closed disposition, the links (42) have been turned so that they (42) lie as nearly parallel one another as possible, approximating an array of numerous sharply angled V-shapes such that the second ends of relatively corresponding pivotal attachment points are brought very near one another, the moveable frame (51) is retracted very near the fixed frame (61) and the spears (14) are withdrawn within their extender guides (5), if present, as far as they (14) can be. Intermediate positions, of course, are those exhibited anywhere between those two extremes.

At the rear of the frame (61) is preferably disposed a feeder line mobility housing (55) in which the feeder lines (3), preferably enwrapped within the bucket (101) by a hydraulic line sheath (105), are gathered and from which they (3) are thereby permitted to extend freely without tangling when the moveable parts of the assembly, including the piston cylinder (2), they (3) supply, are engaged. The mobility housing (55) provides protective containment for a given length of the feeder lines (3) gathered within (55) which are thereby provided sufficient slack to permit them (3) to extend freely without tangling when the moveable parts of the assembly, including the piston cylinder (2) they (3) supply are engaged. The matter of movement is discussed ante.

The moveable frame (51) essentially comprises merely a bar or plate of substance sufficient to keep it (51) rigid and undamaged by the stresses of the invention's use. To it (51), at points along the length thereof (51) the rearmost portion of the spears (14) attach, preferably by welding. Slots preferably cut into the joining portion of the spears (14) enhances the weld. The spears (14), then, fixed to the foremost portion of the moveable frame (51) as they (14) are, extend forward to project through the guide openings (6), if present. In preferred configuration, they (14) are made to terminate in a beveled point, thereby facilitating the hay and manure loosening function mentioned supra.

Within the fixed frame (61), is disposed the mechanism which forces the spears (14) forward. Part of it comprises the hydraulic piston cylinder (2), requiring a continuous hydraulic fluid supply, typically oil, through the feeder lines (3). The cylinder (2) is disposed. A pair of lines (3) runs to opposing portions of the cylinder (2) stated herein, therefore, to be reciprocal, meaning that the hydraulic fluid runs through one line (3) to drive the piston rod (9) in a first direction, allowing it to continue on through and back through the other line (3) to complete a fluid circuit. In this reciprocal system, the latter line (3) also delivers piston rod (9) force in the opposing direction, allowing circulation and retrieval of the fluid in the opposite direction.

In all of those embodiments, the projecting end of the piston rod (9) is attached to an end of one of the opposing extensions (46) of the transverse projection shaft (41) disposed, as its name suggests, generally at a right angle to the forward projection of the spears (14). Attachment may be made by any means is preferred but welding is preferred and even then, with an intervening attaching bracket (45). The shaft's extension (46) lies in a transverse aspect generally parallel and extending fairly straightly from the end of the piston rod (9).

Similarly in all embodiments, the portion of the cylinder (2) opposing that from which the piston rod (9) projects is firmly attached, again preferably by welding, to an end of the second extension (46) of the transverse shaft (41). Since the cylinder (2) is transversely disposed, this provides an extension straightly from its (2) end in the direction opposite that of the first extension (46). The result is an elongated structure, the shaft (41) having at a midportion thereof (41) the piston cylinder, all elements thereof in continuous attachment. Despite the rigidity and unity which such attachment provides, it must be observed that the piston rod (9) moves freely into and out of the cylinder (2), thereby causing the extenders (46) to project outward to a lesser or greater degree.

Bolt holes (44) are provided at points along the length of the extenders (46) through which pivotable bolts (43) will be allowed to pass and freely rotate. To that end, a portion of the shank of the bolts (43) must comprise a smooth unthreaded sector in the manner well known to the art. Thus, any two structures fastened by such bolts (43) will be permitted to pivot against one another at the place of the bolt (43) connection. This point of connection is, therefore, properly designated herein an axial point of connection.

A plurality of spreading links (42) comprise the necessary linkage between the transverse projection shaft (41) and the moveable frame (51). Each spreading link (42) comprises a bolt hole (44) at each end thereof. A first end—although the link (42) is preferably longitudinally symmetrical such that either end could arbitrarily comprise that end—is disposed such that its (42) bolt hole (44) is aligned with a selected bolt hole (44) in the projection shaft (41). A pivotable bolt (43), well known in the art, is then passed through the aligned holes (44) of each member (41, 42). The shaft of a pivotable bolt (43), of course, must be unimpeded by threads which would otherwise prevent the free rotation or spinning character of thereof (43). However, the bolt (43) must be firmly secured in place and this is preferably accomplished by attachment of a threaded nut at the bolt's (44) tip. The spreading link (42), then, is well attached to the projection shaft (42) and yet allowed to pivot upon it freely. Each link (42) is so connected at its (42) first end to the shaft (41), the connection herein characterized as one of pivotable attachment.

The holes (44) disposed in the shaft (41) are so disposed as to provide link (42) connections at points along each edge of the shaft's extensions (46) such that upon connection, links (42) will be disposed along the length of each side thereof (46). What has been provided to this point, thus, is a cylinder (2) and piston rod (9) with attached extensions (46) oppositely directed, each with generally horizontally disposed links (42) connected along the sides of their (46) length.

Bolt holes (44) are also provided along the length of the moveable frame (51)—specifically at the rearward edge thereof (51). The hole (44) of the second end of each spreading link (42) is centered over one of those (44) of the moveable frame (51) and the pivotable bolt (43) passed through and secured as directed supra. Progressing from link (42) to link (42) where each (42) is of equal length, there must be a correspondence between the holes (44) of the projection shaft (41), of the links (42) and of the moveable frame (51). Thus, the distance and angle subtended between the hole (44) of the first end of a particular forwardly disposed link (48) and the second end thereof (48) will be equal to that between the hole (44) of the first end of another forwardly disposed link (48) and the second thereof (48) disposed upon the same projection shaft extension (46). This may produce, for example, a herringbone pattern which comprises regularity and symmetry in design. However, it may also produce an alternate pattern, ante, which does not comprise longitudinal symmetry along the extension (46). Because of the equality of angles and distances addressed supra for members (42) of equal length along a given side of shaft extension (46), they (42) are stated herein as a matter of definition to comprise relative correspondence between them (42). Experience dictates that the better the alignment between relative attachment points, the smoother the operation. Such is the embodiment shown in FIGS. 1–4.

Figure 6:
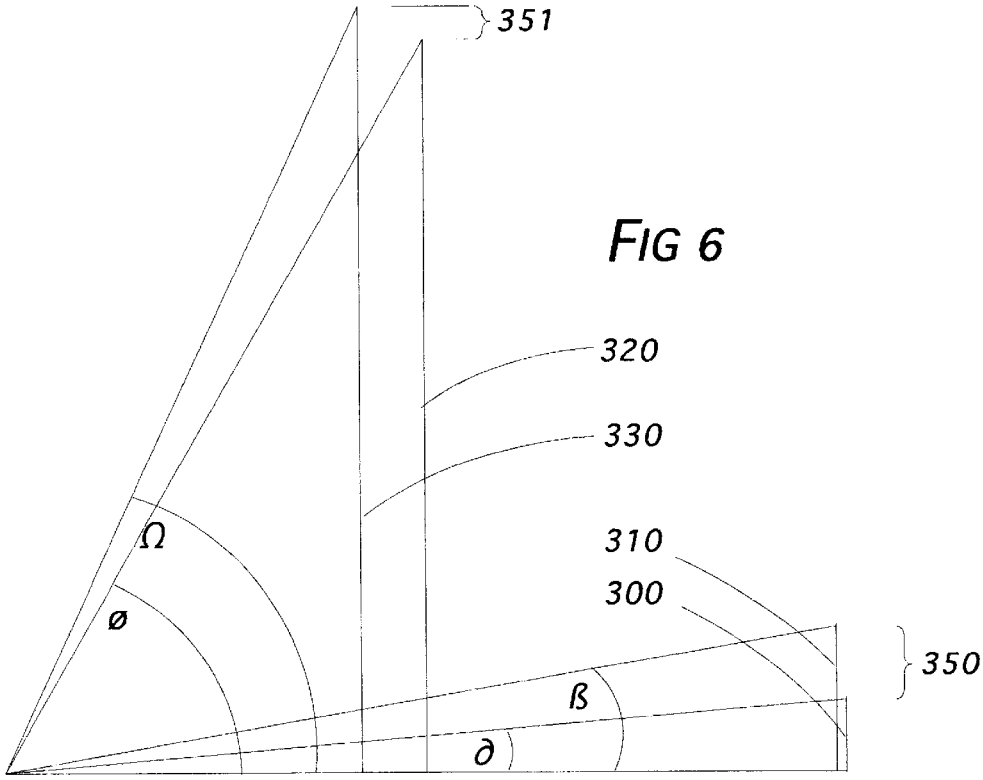
FIG. 6 depicts a geometric construct in which the sine (300, 310, 320, 330) and cosine (301, 311, 321, 331) relationships derived from the subtended angles of the spreading links (42) may be studied. The sine and cosine differences (350, 351 and 352, 353, respectively) are shown so that certain angular changes for small angles ($\partial$, $\beta$) may be compared with equal changes for large ones ($\varnothing$, $\Omega$).
Figure 7:
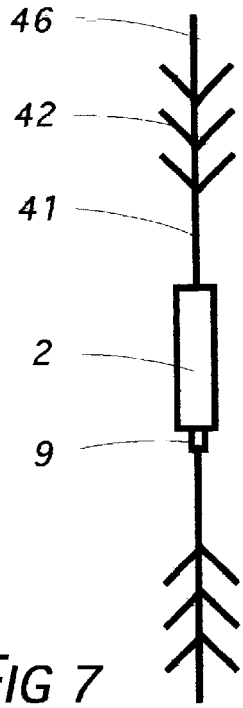
FIGS. 7–10 comprise symbolic illustrations to show workable herringbone or scissor patterns, the former two of the four indicating outwardly open link (42) dispositions; the latter two, inwardly open ones.
Figure 8:
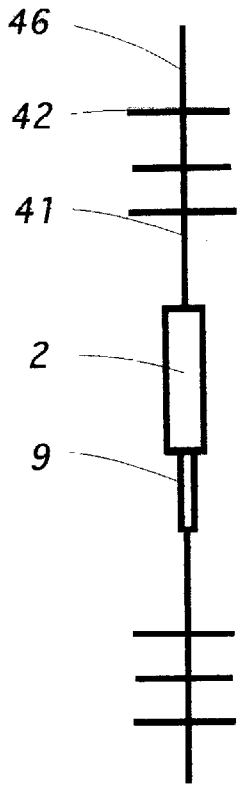
Figure 9:
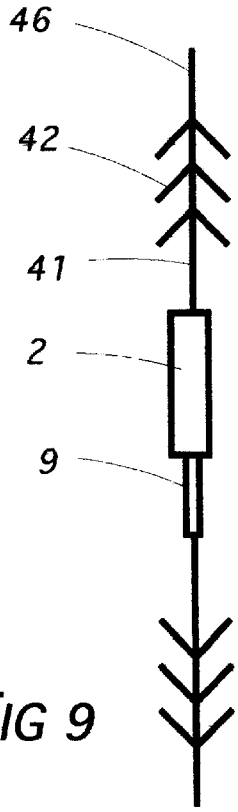
Figure 10:
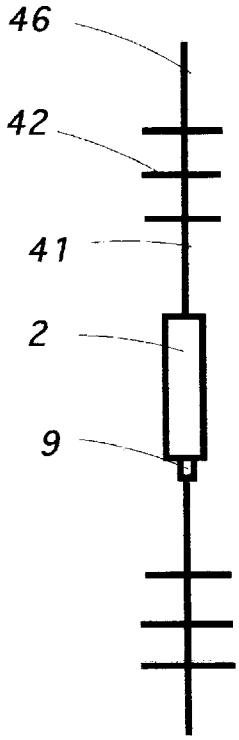
Figure 15:
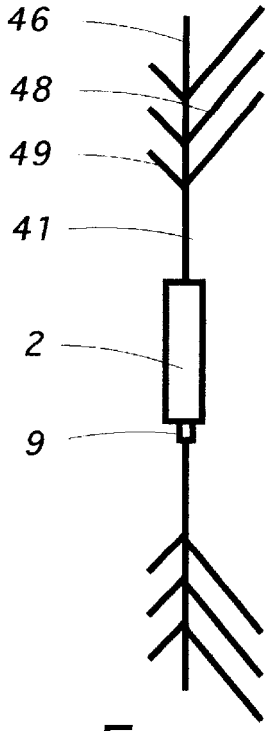
FIGS. 15–19 are symbolic presentations of various conceptual embodiments.

It is not to be inferred, however, that link (41) array must necessarily exhibit a symmetrical herringbone pattern. For instance, it is entirely plausible to have an array of links (42) wherein the forwardly disposed ones (48) are all of equal length with respect to one another (48) and all of the rearwardly disposed links (49) are also of equal length with respect to one another (49) but that, nevertheless, the latter (49) are of length different than that of the former (48). There may or may not be relative correspondence progressing from link (42) to link (42) along a given side of a shaft extension (26). in that arrangement and, as in the case of a longitudinally symmetrical pattern along a shaft extension (26), each member of a pair of forwardly disposed and rearwardly disposed links (48, 49) would, of course, be disposed in alignment with one another in the completely open position. In an intermediate positions, the relative attachment point of the second end of a given forwardly disposed link (48) may be farther inboard or outboard that of a rearwardly disposed one (49) of different length sharing the same bolt hole (44) for their (48, 49) respective first ends. Yet, as shown in FIG. 15, so long as all forwardly disposed links (48) are of equal length with respect to one another (48), and all rearwardly disposed ones (49) are also of equal length with respect to one another (49), the system will operate as intended. In view of what can be learned from a study of the sine-cosine relationships illustrated in FIG. 6, it may well be that such an arrangement of disparate lengths may be desirable.

Figure 11:
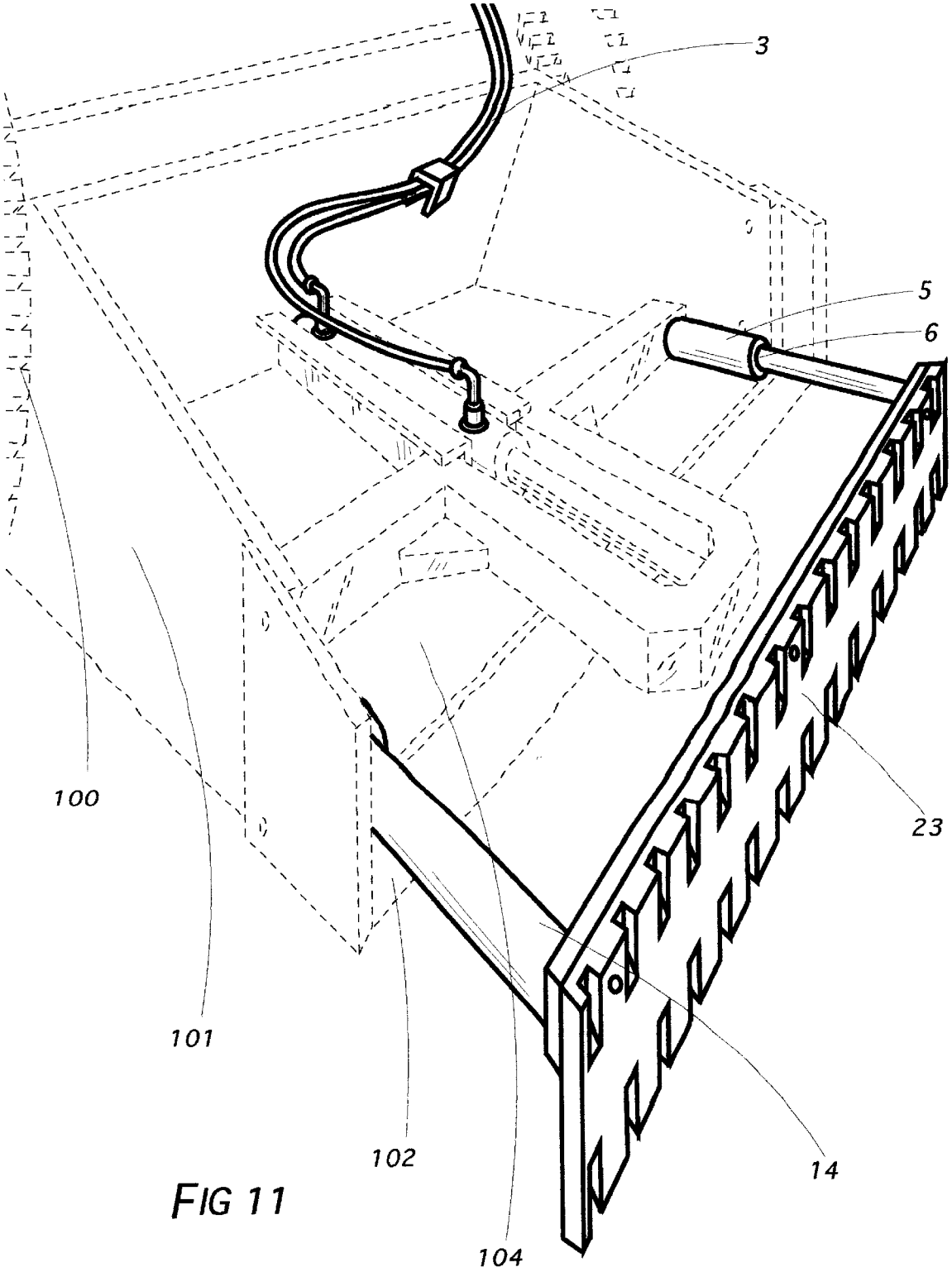
FIGS. 11–14, included because of their adaptability to the subject hereof, incorporate embodiments of the parent application version of the invention employing an elastic scraper (23) for squeegee-like operations, the scraper (23) being fixed in place upon a pair of spears (14). The former two of the four drawings compare the withdrawn to the projected array positions. The latter two illustrate a scraper bracket (106) as a particular means of attachment. A scraper backing plate (25) to keep the the scraper (23) from curling into a biased tire-like curvature—is also present.
Figure 12:
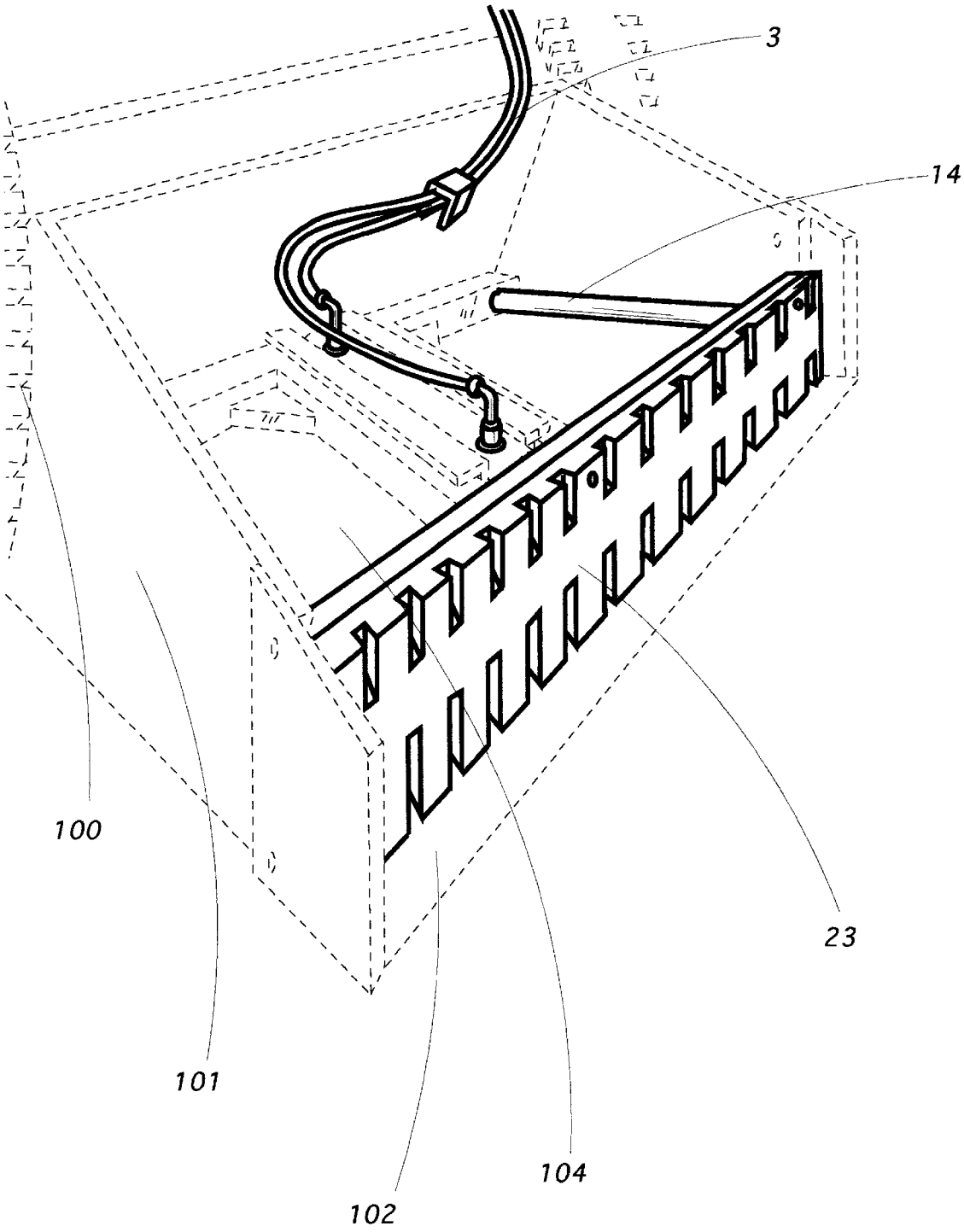
Figure 16:
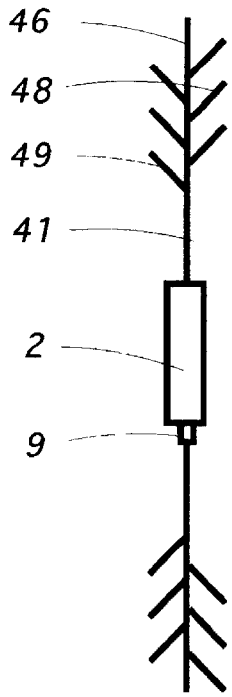
Figure 17:
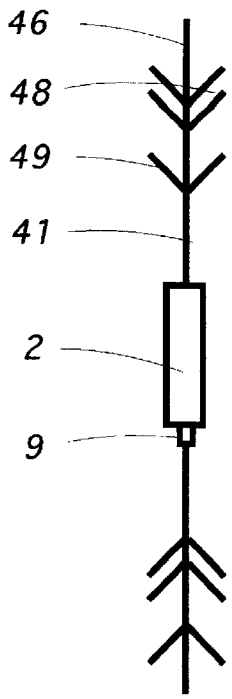
Figure 18:
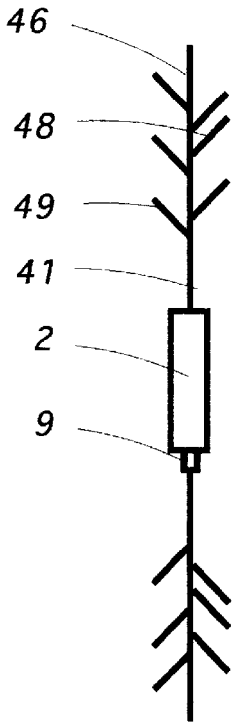

Nor is it to be inferred that the pattern must necessarily exhibit what is widely considered a herringbone configuration. The links (42) may be disposed alternate one another (42) such that the first end of a given rearwardly disposed link (49) lies more inboard the first end of the nearest forwardly disposed link (48) and that all of the other links (48, 49) follow that same pattern as one progresses outward upon a projection shaft extension (46), such as shown in FIG. 16. For that matter, as shown in FIG. 11, paired links (42), and 18, unpaired links (42), there need be no regularity in the pattern. Thus, the distance between the first ends of first (49) and second (49) progressively oriented rearwardly disposed links (49) may be different than that between the first ends, for example, of the second (49) and third (49). Or, similarly, the distance between the first ends of first and second forwardly disposed links (48) may be different from that between the second (48) and third (48). While regularity in the link (42) array is preferred, other arrangements are conceptually workable.

Figure 19:
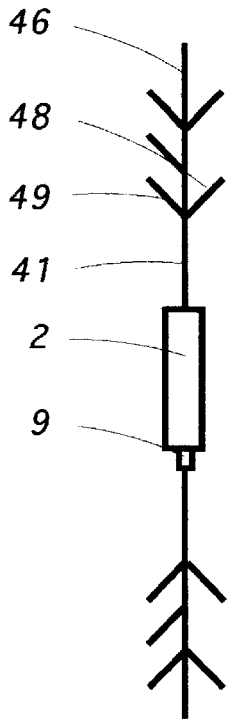

Nor, as FIG. 19 symbolically demonstrates, need there be the same number of forwardly disposed links (48) along a given shaft extension (46) as there are rearwardly disposed links (49) thereon. Nor must there be the same number of forwardly disposed links (48) as there are spears (14); it following that the forwardly disposed links (48) need not necessarily be in alignment with the spears (14).

However, symmetry, regularity in array pattern and relative correspondence between attachment points are all preferred and illustrated in almost all of the drawings. FIGS. 15–19 are exceptions merely to illustrate other array pattern possibilities and to show they are included as part of the inventive concept herein.

As mentioned, supra, when the moveable frame (51) is brought in its closest possible proximity with the fixed frame (61), the assembly (40) is characterized herein as closed. At that disposition, of course, the spears (14) are retracted to their (14) most rearward position. In the embodiment shown in FIGS. 1–5, each link (42) connected to the most rearward portion of the shaft (41)—herein designated a rearwardly disposed link (49)—has its (49) first end disposed inboard its (49) second end. Each link (42) connected to the most forward portion of the shaft (41)—herein designated a forwardly disposed link (48)—also has its (48) first end disposed inboard its (48) second end. The array thus provided comprises a herringbone appearance along that shaft extension (46) with the open portions of V-shaped structures disposed outward. What is thus said is also true of the array disposed upon the opposing shaft extension (46), so that herringbone patterns are displayed pointing in opposite directions. The array is, accordingly, also stated herein to dispose the links (42) in scissor-like fashion.

As with any other interacting assembly of mechanical parts, however, precautions must be taken to avoid damage—in this case to the loading bucket sides (103) made possible by an overextension of the projection shaft (41) when driven by the projecting piston rod (9). For that purpose, a projection stop (62) is provided at a point sufficiently proximate the bucket sides (103) which permits acceptable shaft (41) and link (42) projection without concern that they (41, 42) might impact the sides (103).

In this embodiment, hydraulic force projects the shaft extensions (46) outward and that force is transmitted through them (42) to the fixed frame (61) through the rearwardly disposed links (49) and to the moveable frame (51) through the forwardly disposed links (48). Although this outwardly directed force is transmitted to the fixed frame (61), it cannot move by reason of its (61) fixed—that is, attached—character. The force is, therefore, reflected back in action-reaction manner against the rearwardly disposed links (49). Meanwhile, the same outwardly directed force is transmitted also to the moveable frame (51). The moveable frame (51) is thus thrust forward. Extender guides (5), preferably present, help to assure such forward movement. A resultant component of the outwardly transmitted force, therefore, causes the links (42) by reason of their (42) connections to pry the moveable frame (51) in a forward direction. In short, the outward projection of the piston rod (9), acting through the shaft (41) and links (42) spreads apart the moveable and fixed frames (51, 61, respectively).

As suggested supra, the herringbone patterns, more or less in mirrored relationship one to the other, may be reversed. If this were done, the piston rod (9) must be in the projected position to maintain the assembly closed, that is, with the V-shaped vertices directed outward and the open parts of the V-structure directed inward along each projection shaft extension (46). In such an embodiment, equally feasible to the one just elaborated upon supra, the open portions of the herringbone pattern face one another. In the previously discussed embodiment, it will be remembered, the open parts of the herringbone pattern face outward from one another. FIGS. 7–10 illustrate this arrangement. This invention incorporates both embodiments, the concept being essentially identical, the only empowering difference being the beginning and ending position of the piston rod (9) in making the transition from closed to open or open to closed respective positions. If it were considered a piston has more power operating from withdrawn to projected position than the reverse, then it would seem the embodiment focussed upon supra is perhaps superior to the other. The difference would appear to be trivial, however.

It is now appropriate to consider the relative application of force where angular dispositions are concerned. In manner suggested by that involved with the opening and closing of an umbrella, as power is exerted along a given extension, the degree thereof required for lateral spreading changes as the effort is undertaken. If the angle is very shallow, like the ribs of a closed umbrella—or like the closed links (42) hereof—the transverse movement derived is determined by the sine of the angle. The empowering movement—extending the central post of the umbrella or the projection shaft (41) hereof—is derived by the cosine of the angle. Thus, as FIG. 6 demonstrates—indicating angular traverse for $\partial$, $\beta$, $\phi$ and $\Omega$—where the small angle of five degrees is changed to one five degrees greater, or 10 degrees, the sine difference between $\beta$ and $\partial$ (350) is substantial but the cosine difference between $\partial$ and $\beta$ (352) is almost trivial, meaning that for the same force permitted to act through a very limited distance in projecting the piston rod (9), good results are obtained in terms of forward spear (14) extension.

However, where the larger angle of 60 degrees is changed to one of 65 degrees, the sine difference (351) is trivial but the cosine difference (353) is substantial, meaning that for the same force required to act through a greater distance in projecting the piston rod (9), the results in terms of forward spear (14) projection are not proportionally as good as with the case of the smaller angle.

The umbrella provides an instructive comparison in another respect. As the central umbrella post—the projection shaft (41) herein—is advanced, the lateral movement of the umbrella struts acting upon the ribs is easily derived from an analysis such as in FIG. 6. However, in the substance hereof, the projection of the piston rod (9) is only half-way outward because the cylinder itself (2) is pushed an equal distance in the opposite outward direction. Thus, the piston cylinder (2) is stated herein to be free-floating with reference to those lateral movements. It must, thus, be recognized that the links (42) on each side of the cylinder (2) open their (42) V-shaped structures equally. The force and, therefore, the extension, is shared equally between them, the cylinder (2) moving just as far to the one side as the piston rod (9) does to the other. However, in the subject hereof, forward projection—thus tending to be halved—tends in a compensating sense to become doubled by reason of the unmoving character of the fixed frame (61). The V-shaped link (42) opening both forward and from the rearward fixed point tends to double the forward movement of the spears (14). The net result is that the sine-cosine results achieved by reason of the free-floating character of the piston cylinder (2) and the action-reaction character of the links' (42) abutment against the fixed frame (61) suggest similar thrusting results as with the umbrella.

What has thus far been set forth herein suggests that the spreading links (42) be disposed in pairs with reference to their forwardly disposed (48) and rearwardly disposed (49) members as illustrated in FIGS. 1–4. However, that is not an absolute necessity. Certainly links (42) could be arranged in non-paired array with substantially the same results being achieved. However, one can intuitively see that pairing the links (42) wherein the projection shaft (41) connections for each pair (42) comprise respective points in common—as they are designated herein—provides more assured, evenly balanced and direct transmission of forward resultant force.

Figures 13, 14:
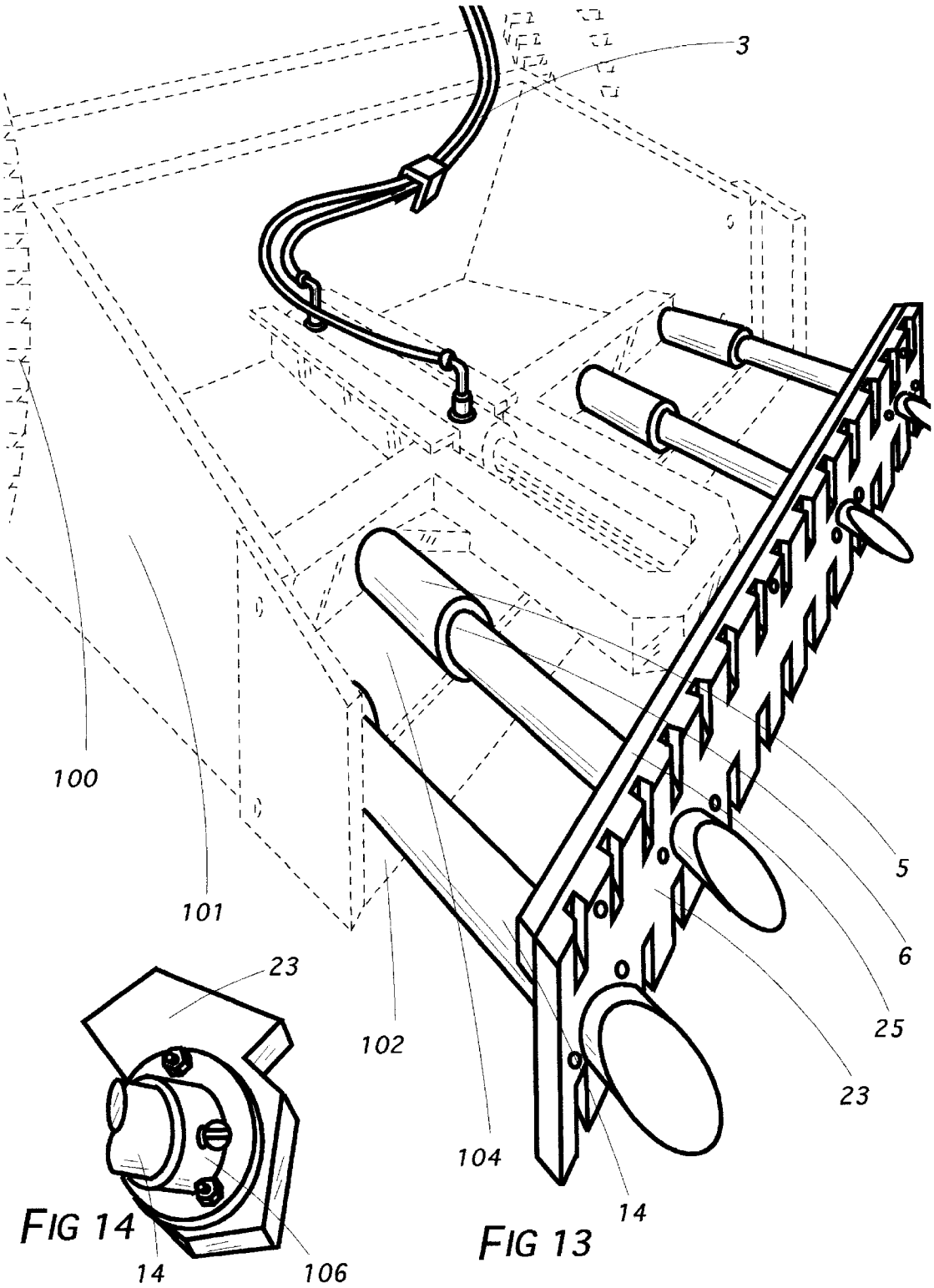

As mentioned supra, an elastic scraper (23) may be mounted upon the spears (14). The scraper (23) may be manufactured for its (23) intended purpose but is often cut from plentiful large commercially available scrapped tires. Because such a tire comprises an inherent ring-shaped bias or curl, in converting it to a scraper (23), it is preferable to brace it all of the way along its extension with a scraper backing plate (25) as shown in FIG. 13. Attachment to the spears (14) may be accomplished by any means known to prior art, an example of which, shown in FIG. 14, comprises a scraper bracket (106).

What is claimed is:

1. A transversely driven projection and retraction assembly disposed by attachment within a loading bucket comprising two sides and a bottom and frontally connected to a utility vehicle, the assembly comprising:

a fixed frame;

a moveable frame;

a plurality of spears, each attached at its rear end to the moveable frame at a point along the length thereof and disposed to project from it in a forward direction;

a hydraulic piston cylinder supplied by reciprocal hydraulic feeder lines, transversely disposed in free-floating manner within and with reference to the bucket and comprising in turn a piston rod disposed to project therefrom and retract thereinto;

a transverse projection shaft comprising opposing extensions, a first thereof attached at one end to the piston rod and the second, to the end of the piston cylinder opposite that from which the piston rod projects;

a plurality of spreading links arrayed generally in a horizontal plane to as to provide rearwardly disposed and forwardly disposed members thereof, a first end of each link pivotally attached to a respective projection shaft extension at a point along the length thereof, a second end of each rearwardly disposed link pivotally connected to the fixed frame at a relatively corresponding point therealong and a second end of each forwardly disposed link pivotally attached to the moveable frame, the forwardly disposed links comprising relative correspondence with reference to one another and the rearwardly disposed links comprising relative correspondence to one another; the connections within the array being such as to dispose the moveable frame in scissor-like fashion at positions more proximate or more distal the fixed frame so as to provide frame dispositions in closed and open positions as well as at any intermediate point between them; whereby a utility vehicle operator may by empowering the hydraulic cylinder cause the moveable frame and attached spears to perform various farm tasks requiring projection and retraction movement.

2. The transversely driven projection and retraction assembly according to claim 1 wherein the means by which the spreading links are pivotally attached comprises pivotable bolts.

3. The transversely driven projection and retraction assembly according to claim 1 wherein when the piston rod is withdrawn into the cylinder, the assembly is disposed in the closed position and each spreading link's first end is disposed inboard that of the second thereof; and when the piston rod is projected from the cylinder, the assembly is disposed in the open position.

4. The transversely driven projection and retraction assembly according to claim 1 wherein when the piston rod is projected from the cylinder, the assembly is disposed in the closed position and each spreading link's first end is disposed outboard that of the second thereof; and when the piston rod is withdrawn into the cylinder, the assembly is disposed in the open position.

5. The transversely driven projection and retraction assembly according to claim 1 wherein the forwardly disposed links along a given projection shaft extension are of length equal to the rearwardly disposed links along that extension.

6. The transversely driven projection and retraction assembly according to claim 1 wherein the distance between the first ends of first and second forwardly disposed links equals that between the first ends of second and third forwardly disposed links, thereby providing regularity in link pattern array.

7. The transversely driven projection and retraction assembly according to claim 1 wherein the rearwardly and forwardly disposed spreading links are disposed in pairs, the projection shaft connections for each pair comprising respective points in common on the shaft.

8. The transversely driven projection and retraction assembly according to claim 7 wherein the links disposed along each shaft extension are symmetrically arranged in herringbone pattern array.

9. The transversely driven projection and retraction assembly according to claim 1 wherein each forwardly disposed link's second end connection is disposed at a point therealong relatively corresponding to the point of each spear's attachment;

so that the support of each spear is enhanced.

10. The transversely driven projection and retraction assembly according to claim 1 wherein the number of forwardly disposed links along a given projection shaft extension is equal to the number of rearwardly disposed links thereon.

11. The transversely driven projection and retraction assembly according to claim 1 further comprising a projection stop.

12. The transversely driven projection and retraction assembly according to claim 1 further comprising a feeder line mobility housing, a spear casing with frontal guide openings disposed therein, a facilitation bevel and an overlying cover.

13. The transversely driven projection and retraction assembly according to claim 1 further comprising an underlying pan.

14. The transversely driven projection and retraction assembly according to claim 1 wherein the transverse projection shaft is connected to the piston rod with attaching brackets.

15. The transversely driven projection and retraction assembly according to claim 1 further comprising one or more extender guides through which the spears are caused to project.

16. The transversely driven projection and retraction assembly according to claim 15 wherein the number of extension guides present is equal to that of the number of spears such that each spear is projected within a guide.

* * * * *